US007025645B1

(12) United States Patent
Hsieh

(10) Patent No.: US 7,025,645 B1
(45) Date of Patent: Apr. 11, 2006

(54) SNAPPINGLY ASSEMBLED SURF FINS

(76) Inventor: Keng-Hsun Hsieh, No. 13, Lane 146, Fuyi Rd., Taiping City, Taichung (TW)

( * ) Notice: Subject to any disclaimer, the term of this patent is extended or adjusted under 35 U.S.C. 154(b) by 0 days.

(21) Appl. No.: 11/027,201

(22) Filed: Dec. 29, 2004

(51) Int. Cl.
*B63B 1/00* (2006.01)

(52) U.S. Cl. ..... 441/79

(58) Field of Classification Search ..... 114/39.15; 441/79

See application file for complete search history.

(56) References Cited

U.S. PATENT DOCUMENTS 6,386,933 B1 * 5/2002 Rewald et al. ..... 441/74
6,764,364 B1 * 7/2004 Hickman et al. ..... 441/79
6,916,220 B1 * 7/2005 Davey et al. ..... 441/79
2003/0087564 A1 * 5/2003 Kelley ..... 441/79
2004/0248482 A1 * 12/2004 Larkin ..... 441/79

* cited by examiner

*Primary Examiner*—Stephen Avila
(74) *Attorney, Agent, or Firm*—W. Wayne Liauh

(57) ABSTRACT

Disclosed is a device disposed in one of a plurality of holes on a body of a surfboard for fixing one of a plurality of fins therein, each fin including an elongated tab extended downwardly, horizontally from a base thereof, the tab including a plurality of spaced protrusions on its either side. The device comprises a central, lengthwise slot including a plurality of spaced projections on its either side above its bottom, wherein responsive to inserting the tab into the slot, the tab is adapted to move rearward by snappingly pushing until the tab is stopped by a rear end of the slot with upper surfaces of the protrusions engaged with lower surfaces of the projections. Either assembly of the fins without sacrificing its fastening or disassembly thereof can be made easy.

6 Claims, 9 Drawing Sheets

SNAPPINGLY ASSEMBLED SURF FINS

BACKGROUND OF THE INVENTION

1. Field of the Invention

The present invention relates to surf fin fixing arrangements, and more particularly to such an arrangement in which one or more fins are securely mounted at a rear of a surfboard by snapping such that either assembly of the fins without sacrificing its fastening or disassembly thereof can be made easy.

2. Description of Related Art

For stability, one or more fins 2, most commonly three, are fixed to a surfboard 1 at its rear as shown in FIG. 1. A prior approach of fixing the fins 2 to the surfboard 1 is disclosed in U.S. Pat. No. 5,464,359 as shown in FIG. 2. A plurality of holes (one is shown) 11 are formed on a rear of the surfboard 1. Each hole 11 is adapted to neatly receive a fixing plug 3. The plug 3 comprises a rectangular slot 31 and two obliquely drilled tapped holes 32 extending from a face and intersecting the slot 31. The fin 2 comprises a pair of tabs 21 extended downwardly from a base thereof. The tabs 21 are inserted into the slots 31. Each of two grub screws 16 is driven home by means of a tool (e.g., screw driver) to fasten the tab 21. This finishes the assembly of the fins 2 on the surfboard 1. For disassembly, simply unfasten the screws 16 by means of a screw driver and then pull the tabs 21 out of the slots 31.

While the cited patent is advantageous for its reliable fixing, its assembly or disassembly is a labor-intensive process. This is not desired. Moreover, the fin 2 tends to break in its joining portion (i.e., V-shaped grooves) with the tab 21. Thus, the need for improvement still exists.

SUMMARY OF THE INVENTION

It is an object of the present invention to provide a surf fin fixing arrangement in which one or more fins are securely mounted at a rear of a surfboard by snapping such that either assembly of the fins without sacrificing its fastening or disassembly thereof can be made easy.

The advantages of the present invention are realized by providing a device disposed in one of a plurality of holes on a body of a surfboard for fixing one of a plurality of fins therein, each fin including an elongated tab extended downwardly, horizontally from a base thereof, the tab including a plurality of spaced protrusions on its either side, comprising a central lengthwise slot including a plurality of spaced projections on its either side above its bottom wherein responsive to inserting the tab into the slot, the tab is adapted to move rearward by snappingly pushing until the tab is stopped by a rear end of the slot with upper surfaces of the protrusions engaged with lower surfaces of the projections.

The above and other objects, features and advantages of the present invention will become apparent from the following detailed description taken with the accompanying drawings.

DETAILED DESCRIPTION OF THE PREFERRED EMBODIMENTS

Figure 1:
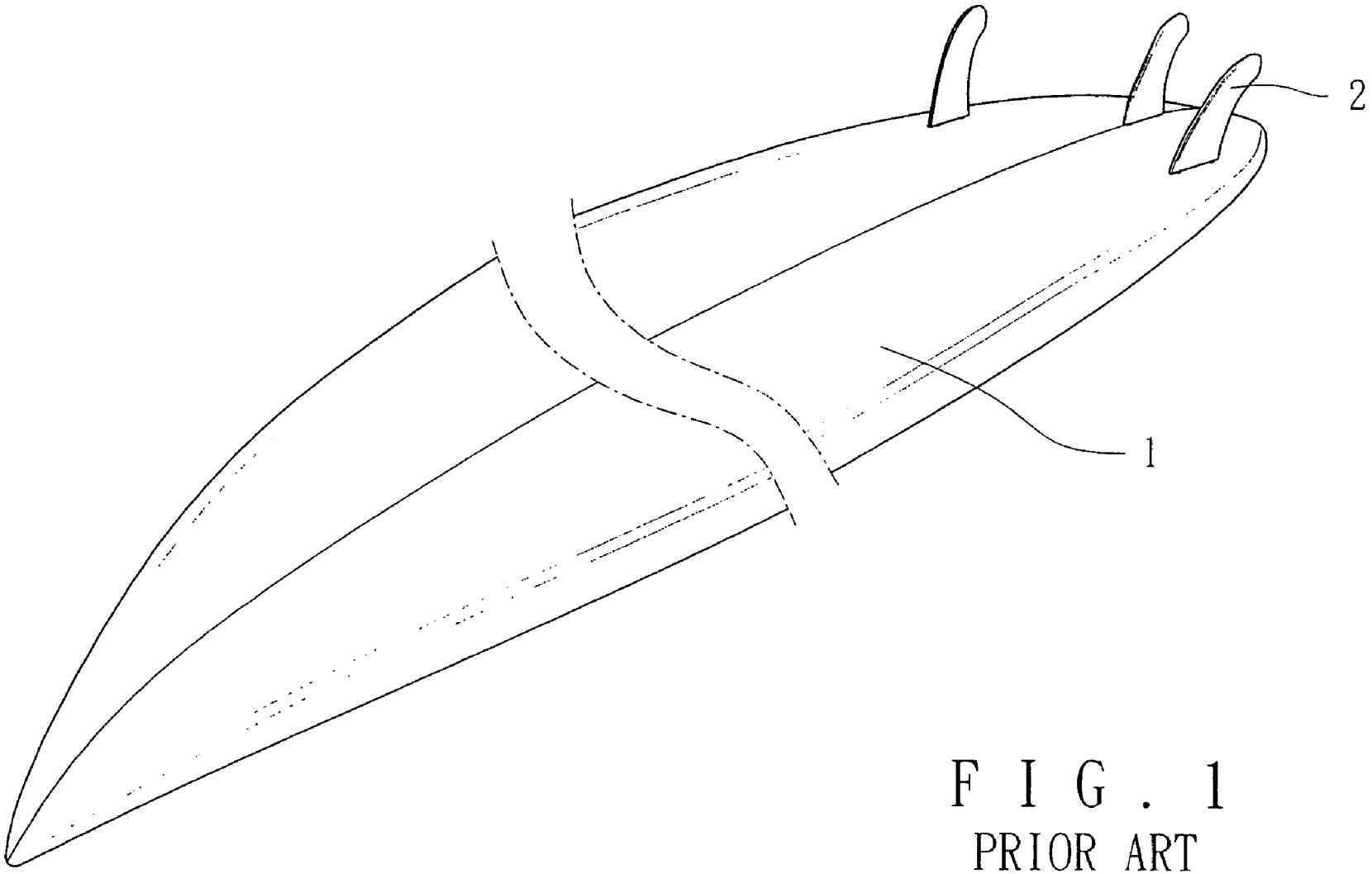
FIG. 1 PRIOR ART
FIG. 1 is a perspective view of a surfboard equipped with three fins.
Figure 2:
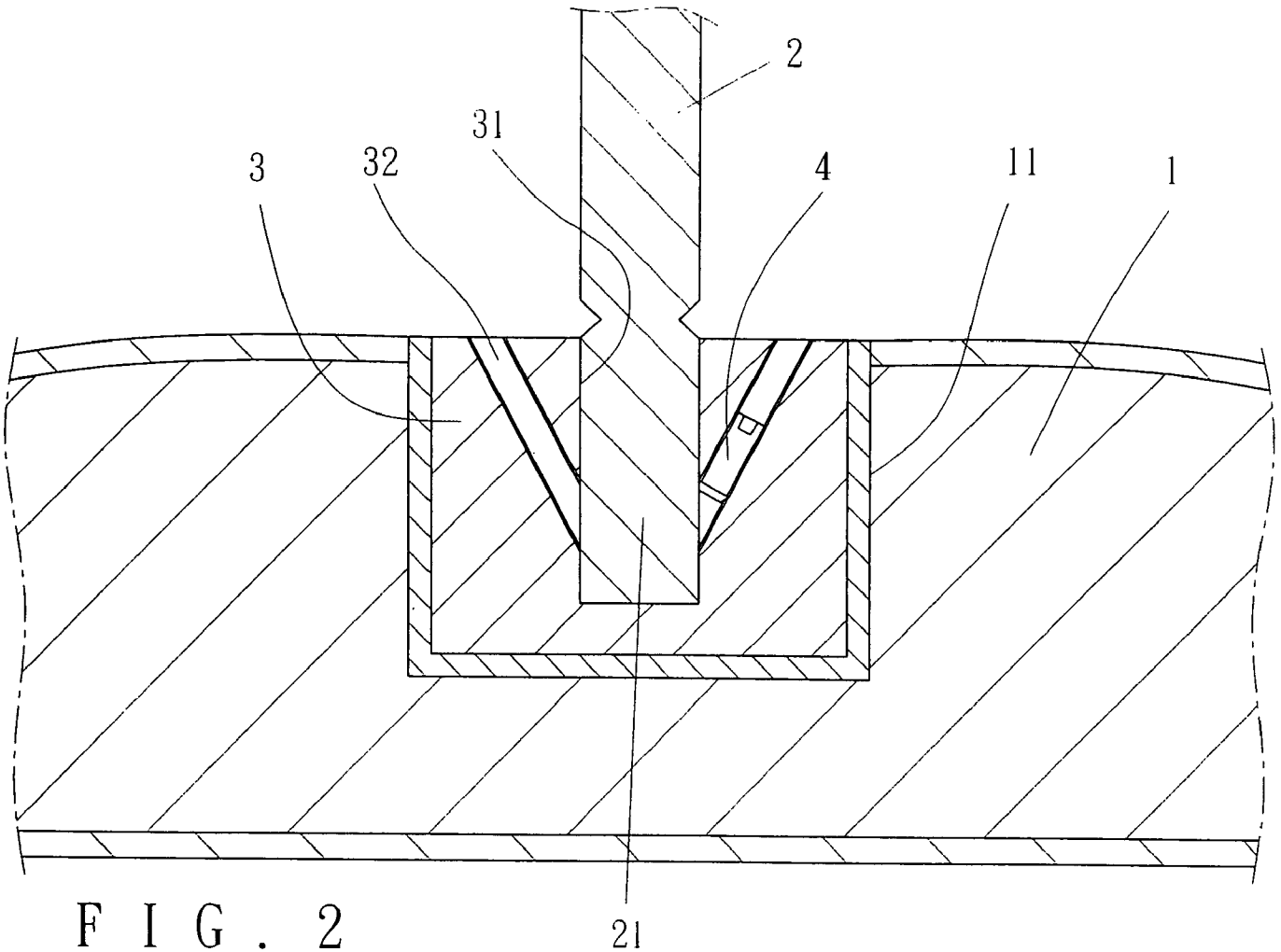
FIG. 2 PRIOR ART
FIG. 2 is a fragmentary sectional view showing the fixing of a fin and a plug in a surfboard disclosed in U.S. Pat. No. 5,464,359.
Figure 3:
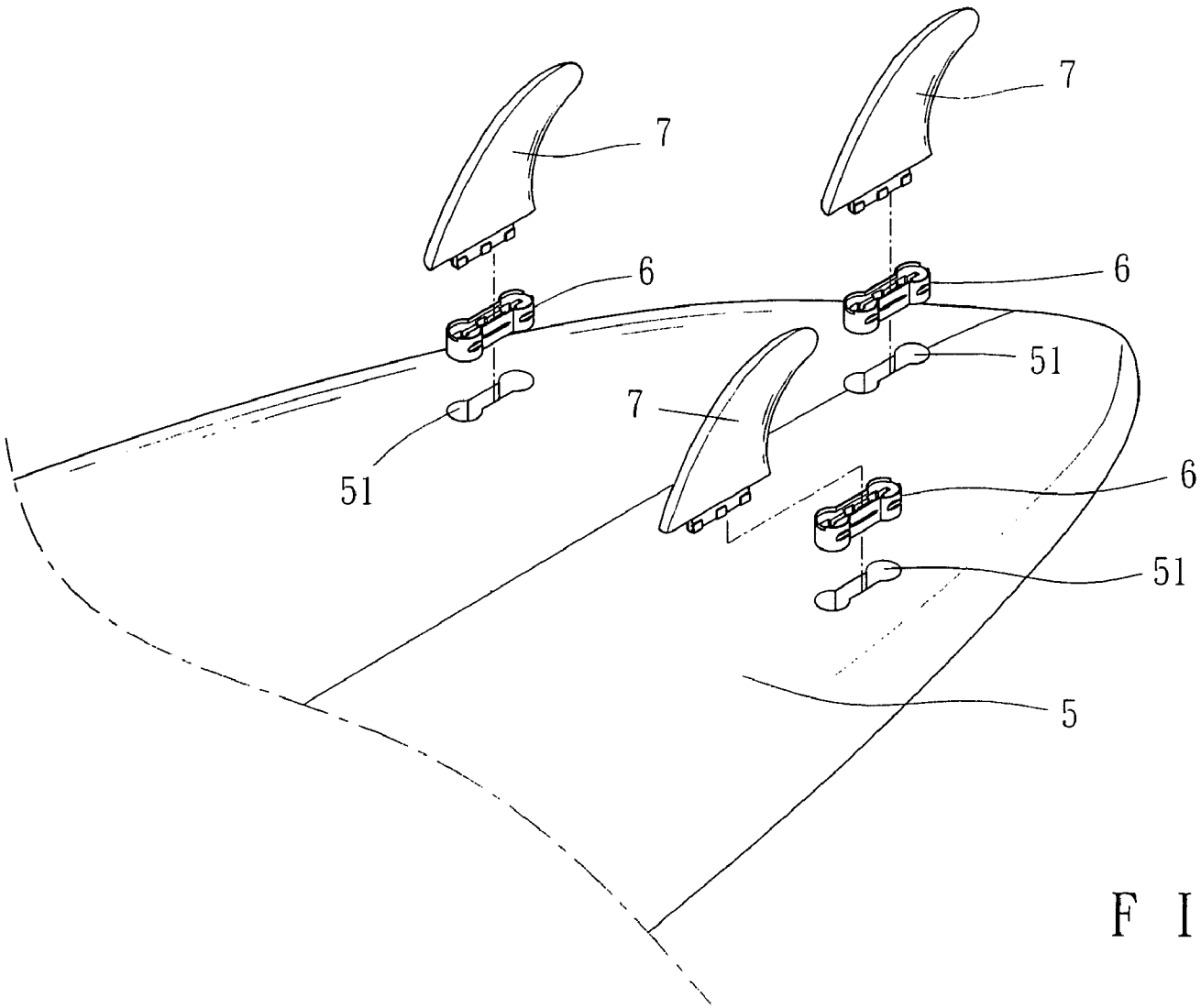
FIG. 3 is an exploded view of three fins to be mounted at a rear of a surfboard according to a fixing system of the invention.
Figure 4:
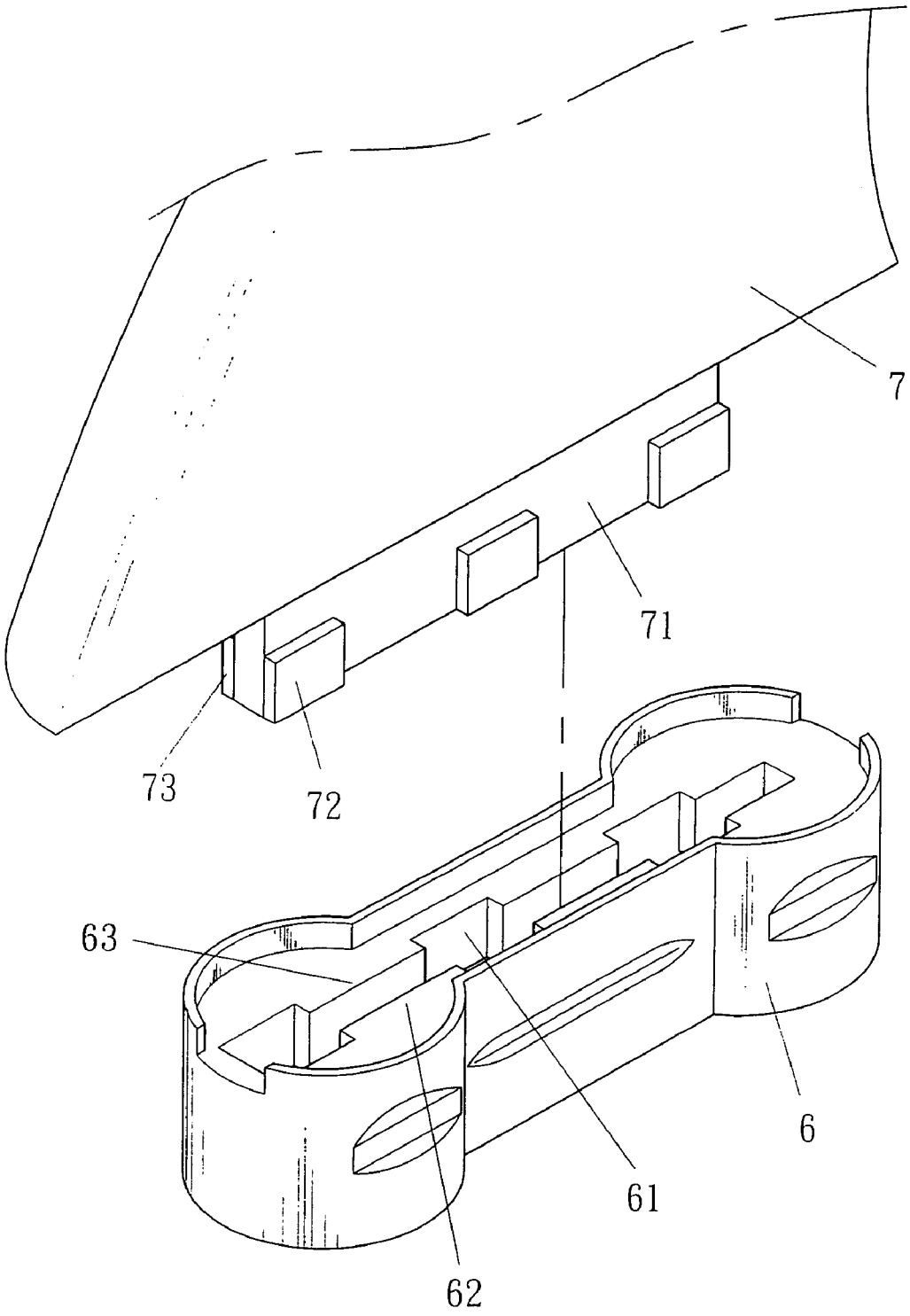
FIG. 4 is an enlarged perspective view of the base of the fin and the plug of FIG. 3.

Referring to FIGS. 3 and 4, a surf fin fixing structure in accordance with a preferred embodiment of the invention is illustrated. A plurality of holes 51 of bar-bell shape are formed on a rear of a surfboard 5. The holes 51 are arranged as a shape of triangle. A plurality of fixing plugs 6 having the same number and shape as the holes 51 are inserted into the holes 51 and are fastened therein by means of an adhesive chosen for compatibility with the materials of the surfboard 5 and the plugs 6. Preferably, each mounted plug 6 has its top face flush with the surface of the surfboard 5. The elongated plug 6 comprises a central, lengthwise slot 61 having three pairs of opposite projections 62 and 63 along its both sides above its bottom and proximate its top. A plurality of fins (three are shown) 7 each comprises an elongated tab 71 extended downwardly, horizontally from a base thereof. The tab 71 has a length smaller than that of the slot 61. On either side of the tab 71 there are provided three spaced protrusions 72 or 73. Each protrusion 72 on one side and a corresponding protrusion 73 on the other side form a pair and each pair has a length and a width to enable itself to neatly fit in one of three enlarged portions of the slot 61 as detailed later.

Figure 5:
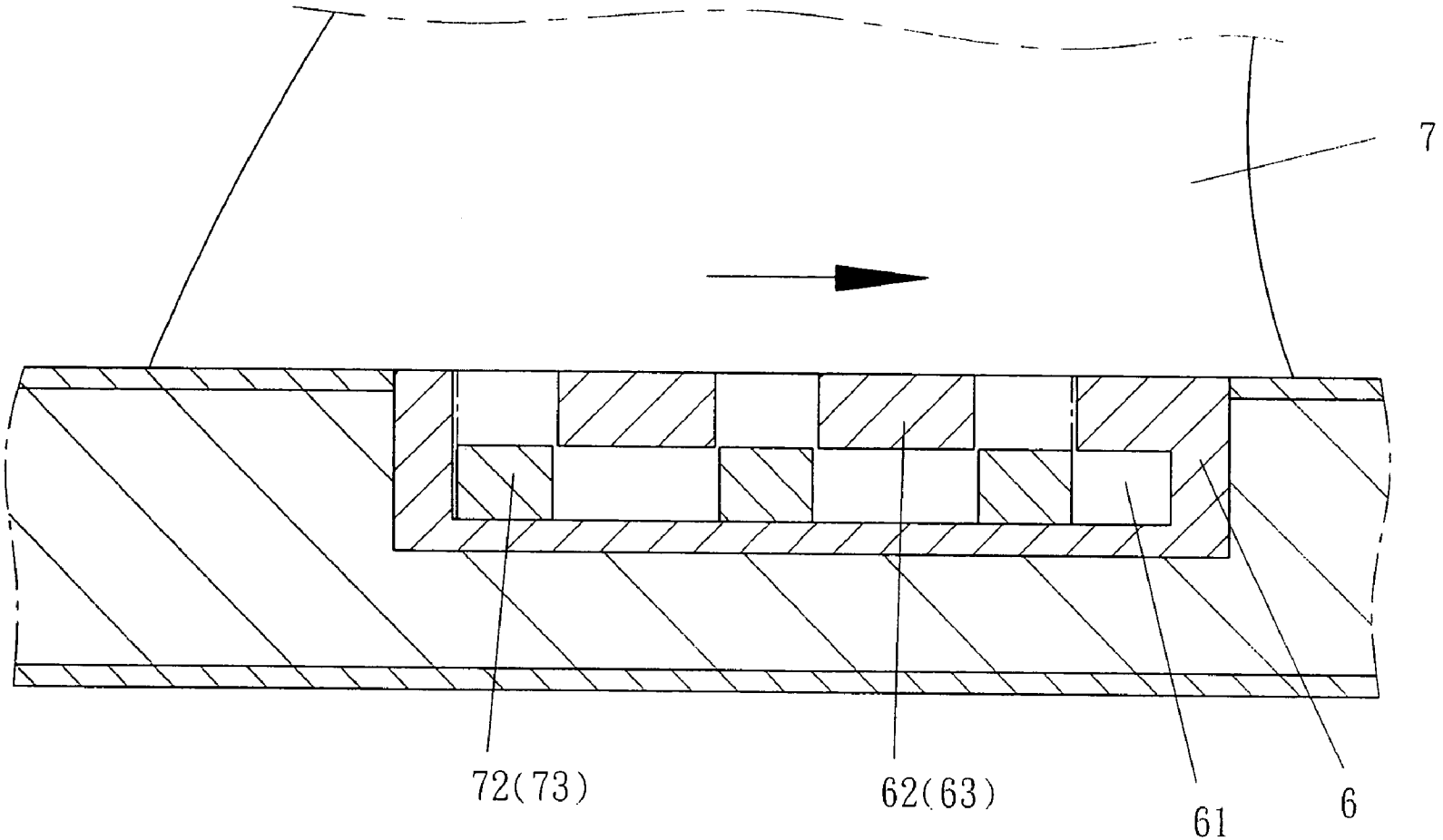
FIG. 5 shows in cross-section the tab of the fin inserted into the slot prior to fastening.
Figure 6:
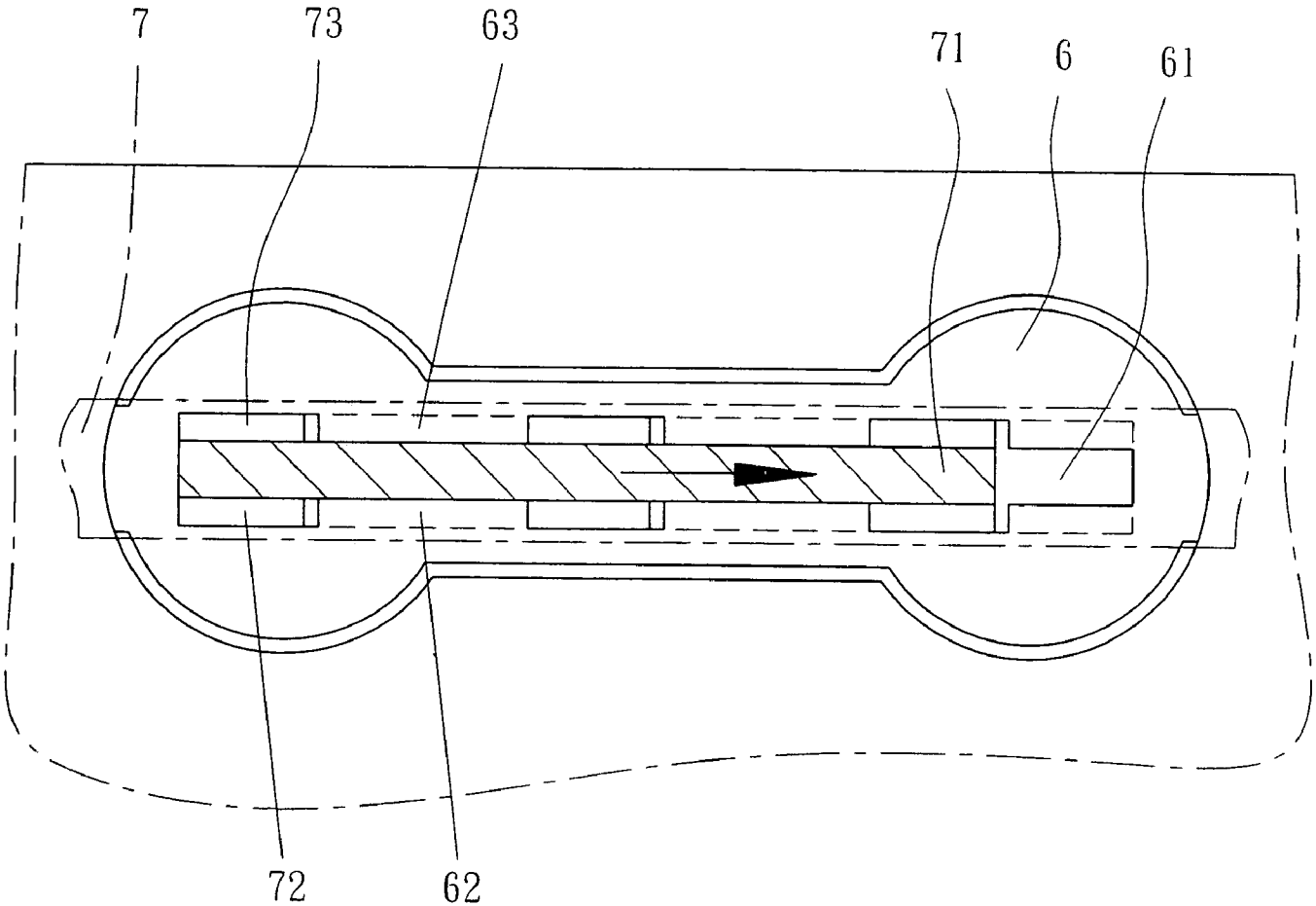
FIG. 6 shows in another cross-section the components of FIG. 5.

Referring to FIGS. 5 and 6, it is shown that three pairs of protrusions 72 and 73 are inserted into the slot 61. At this position, a top face of the protrusion 72 or 73 has substantially the same elevation as a bottom face of the projection 62 or 63. Also, an internal space in a rearmost portion of the slot 61 is dimensioned to receive the rearmost pair of the protrusions 72 and 73. As such, the pairs of protrusions 72 and 73 are adapted to move rearward by snappingly pushing as indicated by arrow as detailed later.

Figure 7:
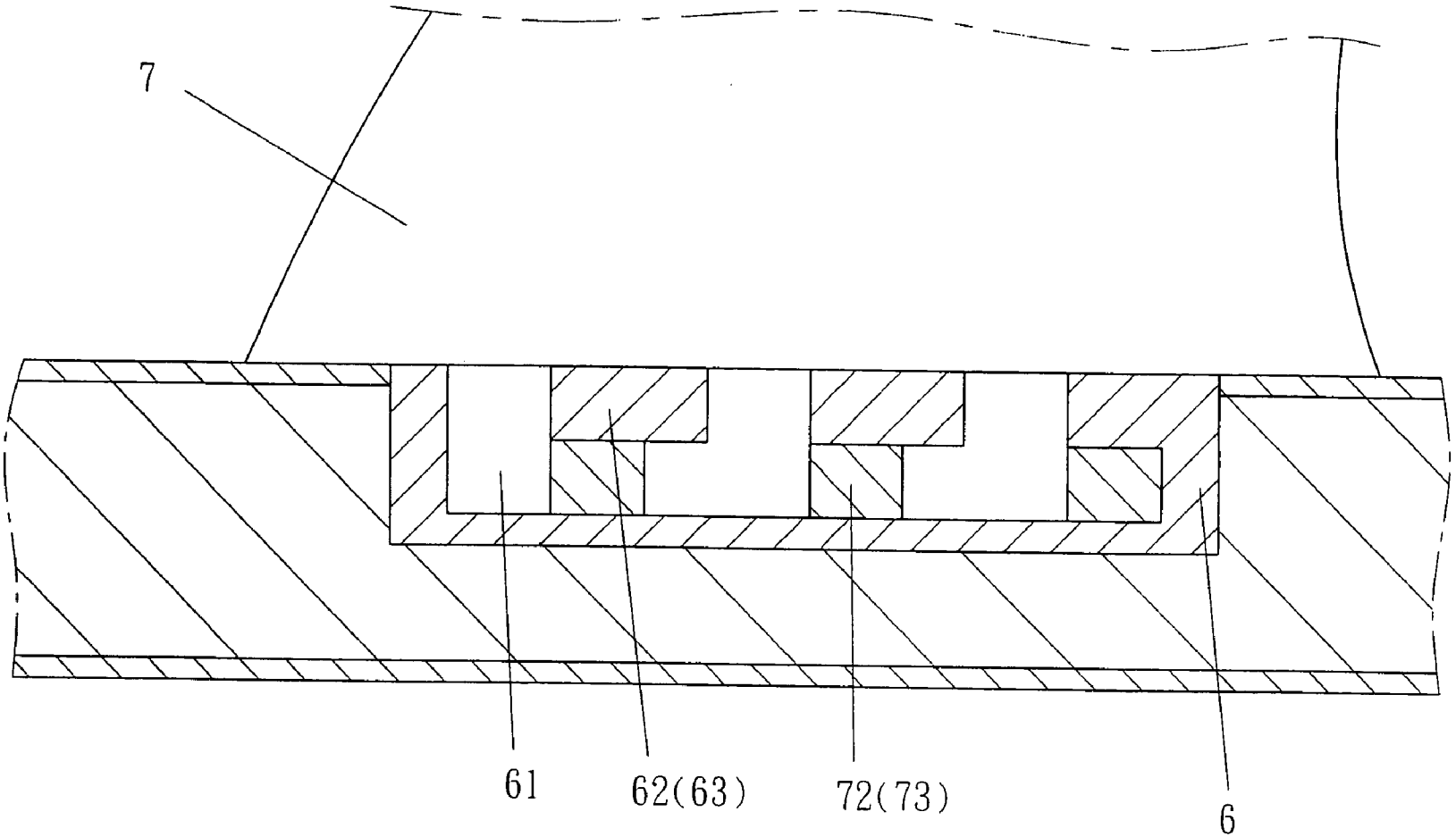
FIG. 7 shows in cross-section the tab of the fin fastened in the slot by pushing rearward (i.e., assembled)
Figure 8:
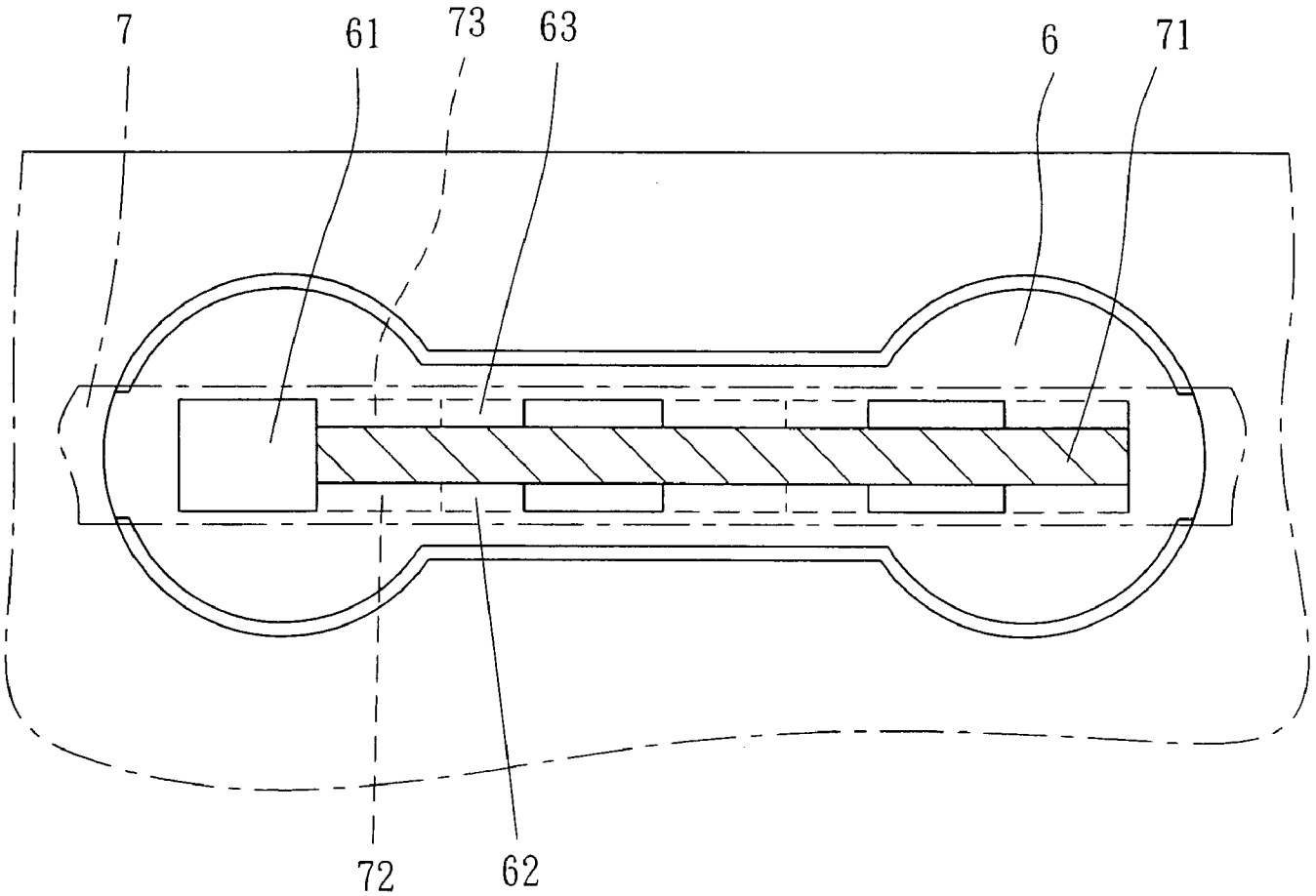
FIG. 8 shows in another cross-section the components of FIG. 7.

Referring to FIGS. 7 and 8, it is shown that the pairs of protrusions 72 and 73 have moved rearward in the slot 61 by pushing until being stopped by a rear end of an inner wall of the slot 61. At this position, the pairs of protrusions 72 and 73 are fastened since their upward movements are stopped by the bottom faces of the projections 62 and 63. Also, the pairs of protrusions 72 and 73 are concealed in the slot 61. This has finished the assembly of fins 7 in the surfboard 5. In view of the above, it is clear that the assembly of fins 7 can be made by an easy insertion and snapping operation. There is no need to worry the disengagement of the fins 7 from the surfboard 5 since the fastening is reliable. Also, the fastening can be enhanced while surfing since water substantially flows in a direction opposing the movement of the surfboard 5. Moreover, the fastening is totally done by the hand rather than any tool. As such, the assembly can be made quickly.

Figure 9:
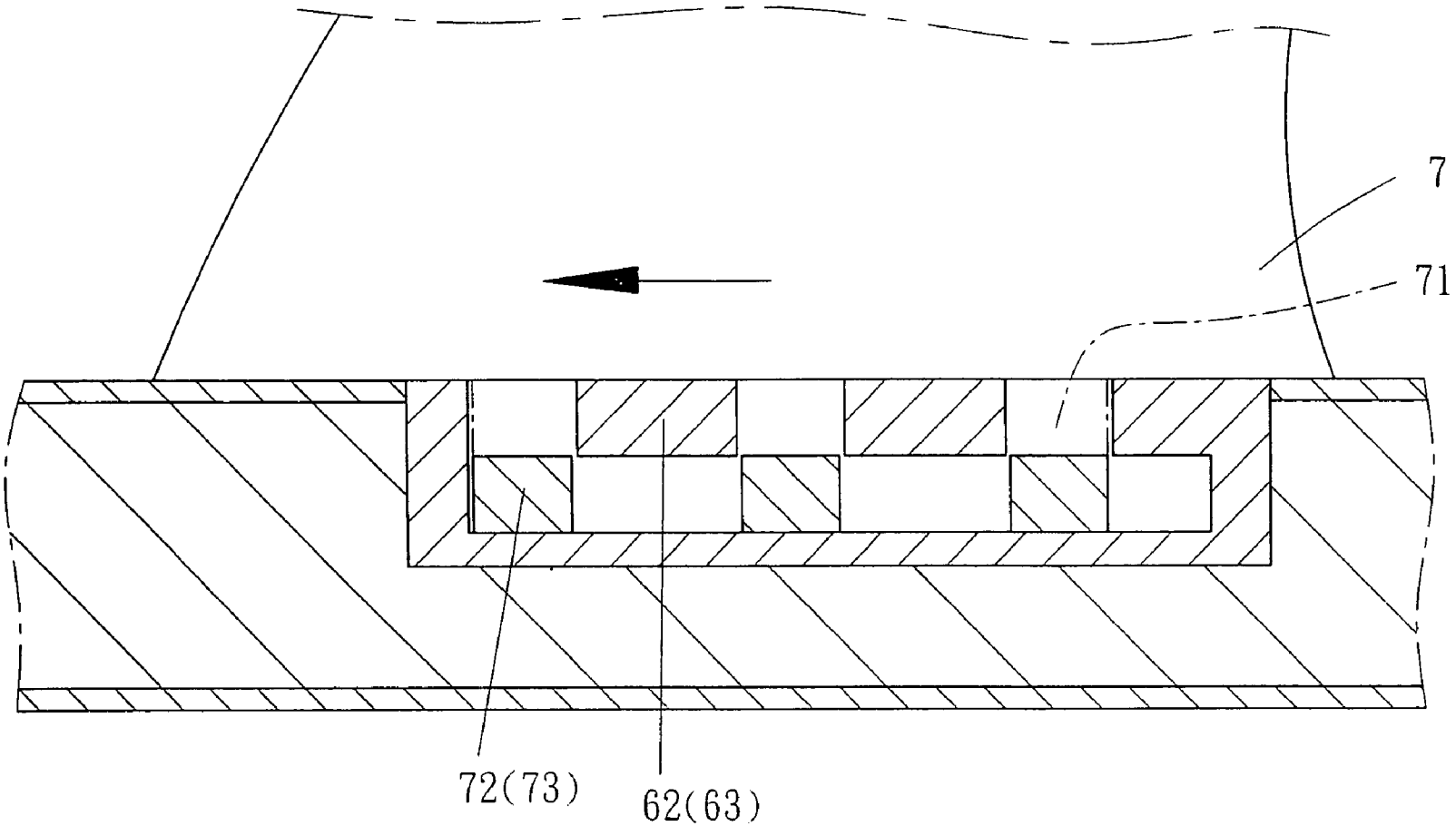
FIG. 9 is a view similar to FIG. 5 where the tab of the fin has moved to an unfastened position prior to pulling out of the slot (i.e., disassembled).

Referring to FIG. 9, for disassembling the fins 7, the steps discussed with reference to FIGS. 5 to 8 are traversed in the opposite direction. That is, push the fins 7 forwardly until being stopped a forward end of the inner wall of the slot 61. At this position, the fins 7 are unfastened. Next, pull the fins 7 upwardly to disengage from the slot 61. It is also clear that the unfastening is totally done by the hand rather than any tool. As such, the disassembly can be made quickly. While the invention herein disclosed has been described by means of specific embodiments, numerous modifications and variations could be made thereto by those skilled in the art without departing from the scope and spirit of the invention set forth in the claims.

What is claimed is:

1. A removable fin system for use in a surfboard comprising:

(a) at least one dumbbell-shaped hole formed in the surfboard, and a matching dumbbell-shaped fixing plug firmly placed in the dumbbell-shaped hole, the fixing plug has a lengthwise elongated slot formed therein;

(b) an elongated tab extending from a base of the removable fin, the elongated tab being constructed to be received in the elongated slot of the dumbbell-shaped fixing plug so as to affix the removable fin to the surfboard;

(c) a plurality of first protrusions formed on an upper portion of both sides of the elongated slot of the fixing plug, the plurality of first protrusions are formed and spaced apart such that they create a plurality of vertical passages in the upper portion of the slot and an elongated horizontal open passage in a lower portion of the slot;

(d) a plurality of second protrusions formed on a lower portion of both sides of the elongated tab, the plurality of second protrusions are formed such that they can be inserted vertically through the plurality of vertical passages in the upper portion of the slot, then move horizontally along the open horizontal passage, so that the plurality of second protrusions are retained below the first protrusions.

2. The removable fin system of claim 1 wherein three first protrusions are formed on either side of the elongated slot, and three second protrusions are formed on either side of the elongated tab.

3. The removable fin system of claim 1 wherein corresponding first protrusions are respectively formed on opposite sides of the elongated slot to form a pair.

4. The removable fin system of claim 1 wherein the first protrusions have top surfaces that are flush with a top surface of the elongated slot.

5. The removable fin system of claim 1 wherein corresponding second protrusions are respectively formed on opposite sides of the elongated tab to form a pair.

6. The removable fin system of claim 1 wherein top surfaces of the second protrusions and bottom surfaces of the first protrusions are substantially aligned after the elongated tab is inserted in the elongated slot so as to allow the elongated tab to be tightly retained in the elongated slot after the elongated tab is horizontally moved in the elongated slot to vertically align the first and second protrusions.

* * * * *